United States Patent [19]

Ashley

[11] Patent Number: 4,515,327

[45] Date of Patent: May 7, 1985

[54] YARN BOBBIN

[75] Inventor: Fred C. Ashley, Columbus, N.C.

[73] Assignee: Milliken Research Corporation, Spartanburg, S.C.

[21] Appl. No.: 593,675

[22] Filed: Mar. 26, 1984

[51] Int. Cl.[3] ..... B65H 75/10; B65H 75/14

[52] U.S. Cl. ..... 242/118.3; 242/118.61; 68/198

[58] Field of Search ..... 242/71.8, 71.9, 118.1–118.61; 68/198; 206/413, 415, 416; 220/302, 324, 326

[56] References Cited

U.S. PATENT DOCUMENTS

| | | | |
|---|---|---|---|
| 1,528,821 | 3/1925 | Flagge | 206/415 |
| 1,966,152 | 7/1934 | Taylor | 242/118 |
| 1,994,118 | 3/1935 | Swanson | 242/118 |
| 2,217,212 | 10/1940 | Brandwood | 242/46.2 |
| 2,554,537 | 5/1951 | Moss | 242/110 |
| 2,585,999 | 2/1952 | Bunch | 242/115 |
| 2,622,825 | 12/1952 | Faris | 242/118.61 |
| 2,656,127 | 10/1953 | Bunch | 242/46.2 |
| 3,045,944 | 7/1962 | Ciniglio | 242/118.2 |
| 3,614,018 | 10/1971 | Jones | 242/118.61 |
| 3,764,083 | 10/1973 | Gretener | 242/46.21 |
| 4,078,741 | 3/1978 | Underwood | 242/118.61 |
| 4,128,215 | 12/1978 | Underwood | 242/118.61 |
| 4,371,123 | 2/1983 | Watanabe | 242/71.8 |
| 4,402,468 | 9/1983 | Tezuka et al. | 242/71 |

*Primary Examiner*—Leonard D. Christian

*Attorney, Agent, or Firm*—Earle R. Marden; H. William Petry

[57] ABSTRACT

Take-up bobbin arrangement in which a compressible plastic yarn dye tube is secured onto a yarn take-up bobbin by an end cap which is secured to the bobbin by detents. The end cap has a reciprocating locking member which prevents the yarn being wound onto the dye tube from pushing the end cap out of the bobbin but at the same time allows ready removal of same without yarn damage. The yarn wound on the compressible yarn tube can be readily slid off the bobbin and used directly in the dye cycle for the yarn.

9 Claims, 3 Drawing Figures

YARN BOBBIN

This invention relates generally to take-up bobbins for yarn and in particular to an improved end cap construction which allows yarn to be wound on a tube member which can be taken directly to the dye vessel without backwinding or replacement of the yarn tube prior to dyeing. Furthermore, the dyed yarn on the original tube can be used directly on the yarn consuming machine such as a knitting machine.

It is therefore an object of the invention to provide a take-up bobbin arrangement which allows the yarn take-up tube to be transported directly to the dye chamber without interchange of the yarn tube.

Other objects of the invention will become readily apparent as the specification proceeds to describe the invention with reference to the accompanying drawings in which.

Figure 1:
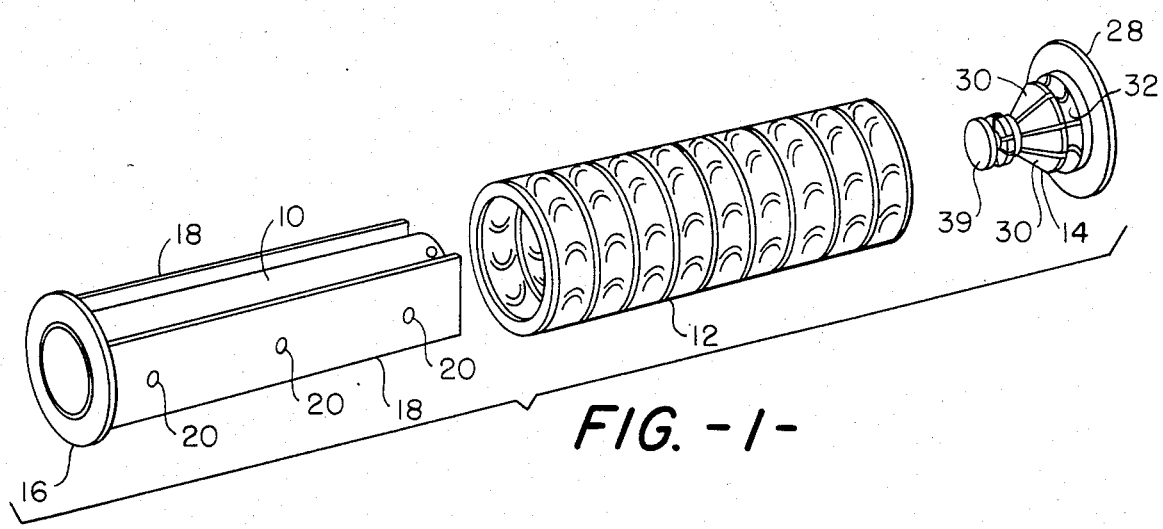
FIG. 1 is an exploded view of the take-up bobbin improvement.

Looking now to FIG. 1 the basic components of the invention are shown in exploded fashion. These components are the take-up bobbin or spindle 10, the plastic dye tube or cone 12 and the end cap 14. The take-up bobbin 10 is, preferably, of stainless steel and has a flange 16 on one end as an abutment for the dye tube 12 when it is placed in position on the bobbin 10. Plastic members 18 are secured to the bobbin 10 by suitable rivets 20 to prevent the dye tube from collapsing onto the bobbin during winding and to allow ready removal after winding. As hereinafter explained the end cap 14 is inserted in the open end of the bobbin 10 to maintain the dye tube 12 in position on the bobbin 10. It can readily be seen that the dye tube 12 is an open web construction which will allow it to be compressed and at the same time allow dye liquor to flow therethrough during the dye cycle.

Prior to this time, plastic dye tubes have been used in conjunction with end caps but have presented a number of problems. This was especially true in the take-up of an elastic yarn, such as textured yarn. The tubes tended to collapse on the bobbin as well as grow in the outward direction. This growth in the outward direction caused yarn to be caught between the end cap and the tube making it difficult to remove the end cap after winding. Further, in many cases, the outward force of the yarn on the end cap would force the end cap out of the take-up bobbin creating a yarn tangle. These problems have been eliminated by the use of the end cap 14 which is locked into position securely during operation but which can readily be removed upon completion of the winding cycle.

The end cap 14 is preferably molded from a suitable plastic material and consists of a body portion 22, a locking member 24 and an o-ring 26. The body portion 22 has a flange 28 to prevent the dye tube from sliding off the bobbin 10 and a plurality of fingers 30. At the base of the fingers 30 adjacent the flange 28 is a semicircular groove 32 for engagement by the detents 34 mounted on the inside of the unflanged end of the bobbin 10. At the outer end of each of the fingers 30 is an upturned flange 35 which cooperates with the body of the fingers 30 to form a groove 36 for the o-ring 26. The outer inner ends of the fingers, collectively form a circular opening 38 for the locking member 24. The locking member 24 is located in the opening 38 and has an end flange member or disc 39 and three circular stepped portions 40, 42, and 44, respectively, of increasing diameter extending away from the flange or disc member 39.

Figure 2:
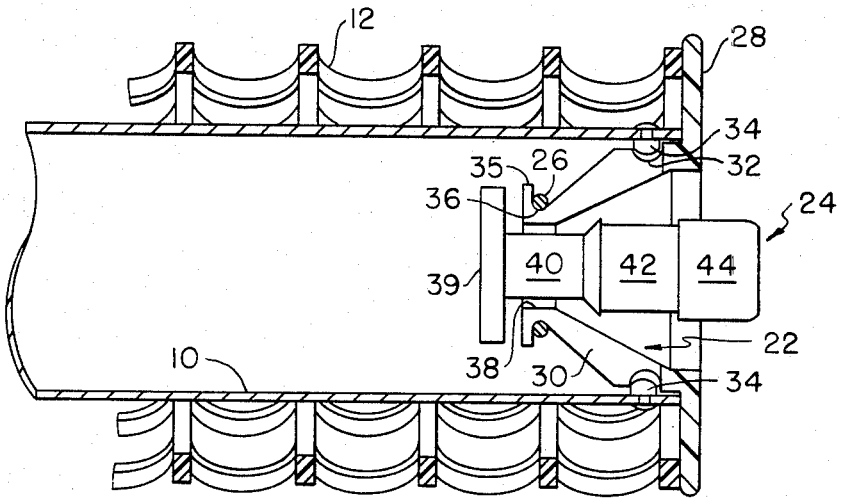
FIG. 2 is a section view of the take-up bobbin arrangement with the end cap in position, but not locked.
Figure 3:
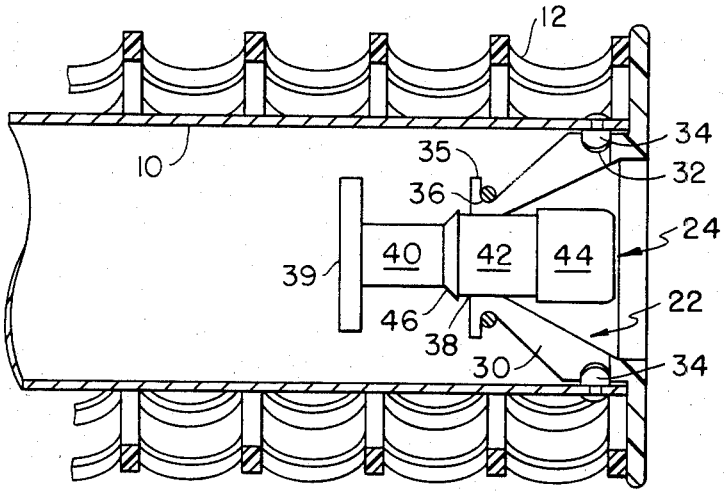
FIG. 3 is a view similar to FIG. 2 except the end cap is locked into position in the take-up bobbin adjacent the dye tube.

In the preferred form of the invention, the improved take-up bobbin arrangement is used on a texturing machine to take-up textured yarn. In use the dye tube 12 is slid over and onto the bobbin 18 until it contacts the flange 16. Then the end cap, with the locking member in the position shown in FIG. 2, is pushed into the other end of the bobbin until the groove 32 engages the detents 34. Then the locking member is pushed inwardly to the position shown in FIG. 3 where the chamfered portion 46 has passed through the circular opening 38 into the position where the fingers engage the surface of the locking member portion 42. This causes the fingers 30 to exert a force upwardly against the detent 34 to secure the end cap in position while the o-ring exerts a force on the tips of the fingers around the opening 38 to keep the fingers from spreading open and allowing the locking member to be pushed all the way through the opening 38. This securely locks the end cap into the end of the bobbin 10 and secures the dye tube between the flanges 16 and 28. Then the take-up bobbin arrangement is mounted on the texturing machine and secured therein to have textured yarn wound onto the tube 12.

When the required amount of yarn is wound on the tube 12 the take-up bobbin arrangement is disengaged from the take-up mechanism of the machine. Then a suitable member is inserted in the flanged end of the bobbin 10 against the end flange member or cap 39 of the locking member 14. The tool (not shown) is pushed against the flange or cap 39 to push the locking member 14 to the position shown in FIG. 2. This releases the force on the detents and allows the take-up bobbin arrangement to be removed from the bobbin 10 by exerting a pulling force on the flange 28. The dye tube 12 with yarn wound thereon can be slid off the bobbin 10 and transported directly to the dye house for dyeing of the yarn on the dye tube 12.

The above described arrangement allows the take-up of yarn, especially an elasticized yarn, on a plastic dye tube which can be used directly in the dyeing cycle without replacement of the yarn core. Further, the unique end cap is readily inserted and removed without damage to the wound yarn.

Although the preferred embodiment of the invention has been described, it is contemplated that changes may be made without departing from the scope or spirit of the invention and I desire to be limited only by the claims.

I claim:

1. A yarn take-up apparatus comprising: a hollow, elongated cylinder with an upstanding flange on one end, a plurality of detents on the inside of said cylinder at the other end, a yarn winding tube telescoped over and substantially coextensive with said cylinder and an end cap secured in said other end of said cylinder preventing said yarn winding tube from being removed from said cylinder, said end cap having a body portion and a locking member slidably mounted in said body portion, said body portion having a first upstanding flange engaging the end of said cylinder and a second portion extending into the interior of said cylinder, said second portion having a groove in the periphery thereof engaging said detents, said second portion having a plurality of fingers forming collectively a circular opening around said locking member, said locking member in one position spreading said fingers to secure said groove against said detents and in a second position allowing the end to be removed from said cylinder.

2. The apparatus of claim 1 wherein said fingers include a means to cause said fingers to exert an inward force on said locking member.

3. The apparatus of claim 2 wherein said means includes an upstanding flange on a plurality of said fingers forming a recess between said fingers and said flanges and an o-ring in said recess.

4. The apparatus of claim 3 wherein said locking member includes a first portion having a first diameter and a second portion of a larger diameter, said larger diameter portion engaging said fingers when said locking member is slid to the position in said circular opening to engage said fingers.

5. The apparatus of claim 4 wherein said locking member includes a disc shaped member located on the end of said first portion having a diameter larger than the diameter thereof.

6. An end cap for a hollow take-up bobbin comprising: a body portion and a locking member slidably mounted in said body portion, said body portion having a flange projecting radially outward therefrom and a plurality of conveying fingers projecting axially therefrom with each of said fingers projecting in the same direction, a groove formed in the periphery of said body portion adjacent said flange, the fingers of said body portion ending in substantially the same plane and forming a substantially circular opening therebetween, said locking member being slidably mounted in said circular opening and means to urge said fingers radially towards said locking member.

7. The end cap of claim 6 wherein said locking member has a first portion of one diameter and a second portion of a second larger diameter, said larger diameter portion engaging said fingers when said second portion is slid into said circular opening.

8. The end cap of claim 7 wherein said means to urge said fingers includes an upstanding flange member in each of fingers forming a recess between said flange and said fingers and an o-ring located in said recess.

9. The end cap of claim 8 wherein said locking member includes a disc shaped member located on the end of said first portion having a diameter larger than the diameter thereof.

* * * * *